United States Patent [19]

Freisler

[11] 4,371,008

[45] Feb. 1, 1983

[54] GRIPPER HEAD FOR LOOMS WORKING WITH REMOVAL OF THE FILLING THREAD FROM STATIONARY BOBBINS

[75] Inventor: Erhard Freisler, Bubikon, Switzerland

[73] Assignee: Rüti Machinery Works Ltd., Rüti, Switzerland

[21] Appl. No.: 179,106

[22] Filed: Aug. 18, 1980

[30] Foreign Application Priority Data

Sep. 5, 1979 [CH] Switzerland ..... 8029/79

[51] Int. Cl.[3] ..... D03D 47/20

[52] U.S. Cl. ..... 139/348

[58] Field of Search ..... 139/440, 443, 446, 447, 139/448

[56] References Cited

U.S. PATENT DOCUMENTS 3,519,028 7/1970 Golobart ..... 139/448

3,901,284 8/1975 Riolet ..... 139/448

4,062,382 12/1977 Rohr et al. ..... 139/448

*Primary Examiner*—Henry Jaudon

*Attorney, Agent, or Firm*—Werner W. Kleeman

[57] ABSTRACT

A gripper head for looms working with removal of the filling thread from stationary bobbins comprises a clamping gap formed by a fixed stop and a movable clamping tongue. The clamping gap serves to fixedly clamp a filling thread which passes through the clamping gap essentially perpendicular to the central plane of the warp threads. The clamping tongue is structured to be displaceable in the lengthwise direction of the gripper head for opening and closing the clamping gap. Due to this actuation of the clamping tongue, by displacement thereof in horizontal direction, the clamping tongue is insensitive to flutter movements of the gripper head caused by vertical oscillations and there is ensured for more positive clamping of the filling thread.

7 Claims, 7 Drawing Figures

GRIPPER HEAD FOR LOOMS WORKING WITH REMOVAL OF THE FILLING THREAD FROM STATIONARY BOBBINS

CROSS-REFERENCE TO RELATED CASES

This application is related to the commonly assigned, co-pending United States application Ser. No. 8543, filed Feb. 1, 1979 of Hans Zollinger, entitled: "Withdrawing Carrier For Looms With Removal Of The Filling Thread From Stationary Bobbins", and also to the commonly assigned co-pending U.S. application Ser. No. 06/179,105, filed Aug. 18, 1980, of Lothar Köhler, entitled "Threaded Light Metal Gripper With Reinforcement Rib".

BACKGROUND OF THE INVENTION

The present invention relates to a new and improved construction of a gripper head for looms working with removal of the filling threads from stationary bobbins or spools. The gripper head of the invention is of the type comprising a clamping gap formed by a stationary stop and a movable clamping tongue, the clamping gap serving for fixedly clamping a filling thread passing through the clamping gap essentially perpendicular to the central plane of the warp threads.

Gripper heads of this type are employed at gripper looms and serve the purpose of seizing the filling thread withdrawn from a stationary bobbin by means of a first gripper head, the so-called bringer-gripper or inserting carrier, introducing such seized filling thread approximately up to the center of the shed, at that location transferring the filling thread to a second gripper head, the so-called taker-gripper or withdrawing carrier, and then, finally drawing the filling thread through the second half of the shed. After departure of the taker-gripper out of the group of warp threads, the clamped filling thread is released. In order to drive the gripper heads, there are employed oscillating rigid rods which can be moved towards one another or flexible bands or tapes, at the front ends of which there are secured the gripper heads.

These gripper heads, which also are referred to by those skilled in this technology as clamping grippers, originally were designed such that the filling thread passed through the clamping gap and also the gripper head essentially parallel to the central plane of the warp threads. However, it has been found that such horizontal thread guiding in the gripper head is not capable of operating completely satisfactorily, either at the tape gripper looms and equally at the rod gripper looms. In particular, it is extremely difficult to maintain both of the gripper heads sufficiently stable in a direction perpendicular to the central plane of the warp threads such that the thread transfer at the center of the shed can always be accomplished in a positive manner.

It is for this reason that the gripper heads, during the past years, have been replaced by gripper heads of the previously mentioned type, wherein the filling thread passes through the clamping gap essentially in vertical direction. Gripper heads of this type are known to the art, for instance, from U.S. Pat. No. 4,062,382, granted Dec. 13, 1977, and U.S. Pat. No. 4,071,055, granted Jan. 31, 1978.

In practice, these gripper heads have indeed proven themselves to be superior to the first-mentioned prior art gripper heads, but nonetheless it can happen that notwithstanding a faultless functioning of the clamping tongue, the filling thread is suddenly released, particularly by the taker-gripper, and thus, is not completely inserted into the shed. This disturbance apparently is attributable to vibrations of the gripper head during the filling or weft insertion. These vibrations also can be transmitted to the clamping tongue, and, in unfavorable situations, can result in undesirable deflection thereof.

SUMMARY OF THE INVENTION

Therefore, with the foregoing in mind, it is a primary object of the present invention to provide a new and improved construction of gripper head for shuttleless looms working with removal of the filling thread from stationary bobbins, which is not associated with the aforementioned drawbacks and limitations of the prior art constructions.

Another and more specific object of the present invention aims at improving upon the heretofore known gripper heads such that disturbances of the aforementioned type can be positively eliminated, and thus, the filling thread no longer can be unintentionally released.

Now in order to implement these and still further objects of the invention, which will become more readily apparent as the description proceeds, the gripper head of the present invention is manifested by the features that the clamping tongue is structured to be displaceable in the lengthwise direction of the gripper head in order to open and close the clamping gap.

Hence, the inventive clamping tongue is thus no longer pivoted out as was heretofore the case for the purpose of releasing the clamped filling thread, rather it is displaced, and specifically, in the lengthwise direction of the gripper head. This affords the beneficial result that the clamping gap of the gripper head no longer can be opened by vibrations in vertical direction.

With vertically deflectable clamping tongues, the opening of the clamping gap is accomplished by applying pressure from above upon the clamping tongue. Since the spring force of the clamping tongue must be relatively strong, this pressure also must have a correspondingly large value or magnitude. Due to the sudden or abrupt application of the pressure at the clamping tongue, such produces not inappreciable loading of the gripper head and the flexible tape or band which carries such gripper head. This loading, during continuous operation, can lead to rupture of the tape at the region of the rear end of the gripper head. Also this disturbance factor is completely eliminated with the displaceable clamping tongue of the present invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE PREFERRED EMBODIMENTS

Figures 1, 2, 3:
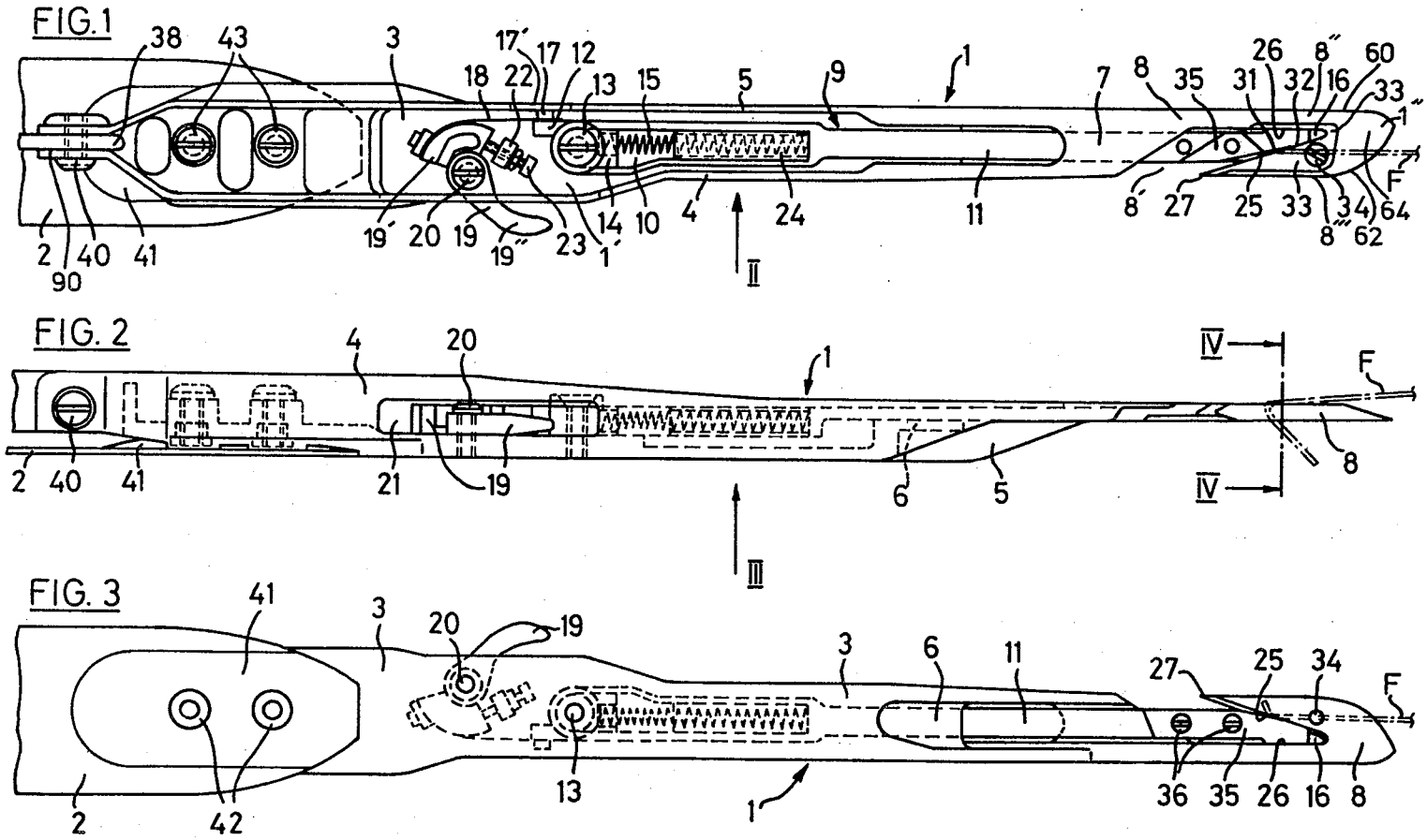
FIG. 1 is a top plan view of a taker-gripper or withdrawing carrier according to the invention.
FIG. 2 is a front view of the taker-gripper shown in FIG. 1, looking in the direction of the arrow II thereof.
FIG. 3 is a front view of the gripper of FIG. 2 looking in the direction of the arrow III thereof.

Describing now the drawings, the taker-gripper 1 illustrated in FIGS. 1 to 5, which is mounted, as shown, at the front end of a flexible tape or band 2 serving for driving the taker-gripper 1 in a manner well known in this technology, will be seen to contain a lengthwise extended form of essentially U-shaped, cross-sectional configuration. At its rear portion, which is attached to the flexible tape or band 2, the taker-gripper 1 comprises a base portion 3, a first side wall 4 which confronts the cloth fell A, (FIG. 4), and a second side wall 5. The base or bottom portion 3 is closed towards the front in the direction of the gripper tip 1" by a step-shaped raised portion or protuberance 6. Thereafter, both of the side walls 4 and 5 are connected with one another at the gripper top surface by a web 7 or the like and extend towards the gripper tip 1" so as to finally form a substantially flat hook 8.

Internally of the hollow space enclosed by the base portion 3, side walls 4 and 5, step-shaped raised portion 6 and web 7, there is arranged a lengthwise extending or elongate clamping tongue 9 which is displaceable in the lengthwise direction of the taker-gripper 1. The clamping tongue 9 possesses at its rear portion or part at the region of the base portion 3 a prismatic shape having an elongate, forwardly and rearwardly closed opening or throughpassage 10, at which merges, in the direction of the gripper tip 1", an elongate, flat band-like portion 11. At the rear closure of the opening or throughpassage 10, there is formed an entrainment projection 12. The prismatic clamping tongue portion 9' containing the opening or throughpassage 10 bears upon the base portion 3 of the taker-gripper 1, while the band-shaped or band-like portion 11 of the clamping tongue 9 extends between the web 7 and the step-raised portion 6.

Figure 4:
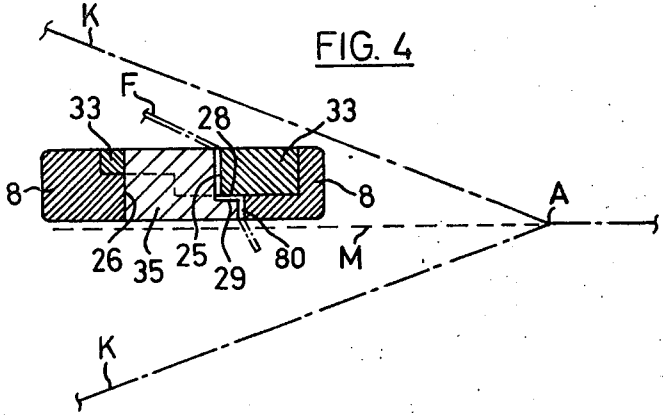
FIG. 4 is a sectional view, on an enlarged scale, of the taker-gripper shown in FIG. 2, the section being taken along the line IV—IV thereof.
Figure 5:
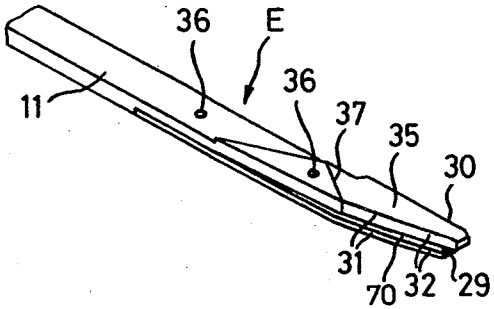
FIG. 5 is a fragmentary perspective view of a detail of a clamping tongue of the taker-gripper of FIG. 1.
Figure 6:
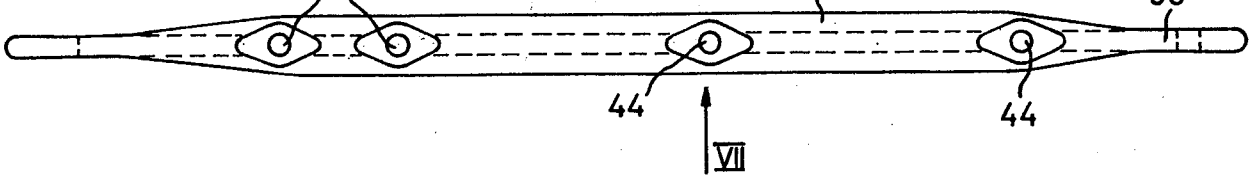
FIG. 6 is a top plan view of a reinforcement element which is threadably connected to the rear end of the taker-gripper of FIG. 1.
Figure 7:
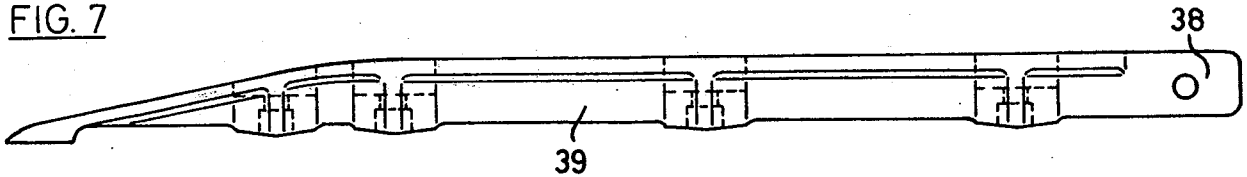
FIG. 7 is a front view of the reinforcement element shown in FIG. 6, looking in the direction of the arrow VII thereof.

During operation of the loom, the taker-gripper 1 is inserted from the left side of the loom into the shed; the flexible tape or band 2 and the plane of the hook 8 are located parallel to the central plane M of the warp threads K (FIG. 4).

At the base portion 3 there is secured by means of a fastening screw or threaded bolt 13 or equivalent structure a guide element 14 which extends into the opening or throughpassage 10 and forms a guide for the rear part of the clamping tongue 9. In this guide element or piece 14 there is inserted the one end of a spiral spring 15 or equivalent structure, the other end of which presses against the front closure of the opening or throughpassage 10. By means of the spiral spring 15 the tip of the bandshaped part 11 of the clamping tongue 9 is thus pressed into the mouth 16 of the hook 8.

At the entrainment shoulder 12, there is attached, by means of a fastening screw or threaded bolt 17 the one end of a blade or leaf spring 18 or equivalent structure, the other end of which is mounted at a double-arm pivotal lever 19. The second side wall 5 of the taker-gripper 1 is provided at the region of the screw or bolt 17 with an opening 17' rendering possible access to the screw 17. The pivotal lever 19 is pivotable about a screw or bolt 20 which is threaded into the base portion or part 3 and, as shown, consists of a circular sector-shaped portion or part 19' at which there is mounted the leaf spring 18, and an actuation finger 19" which protrudes out of the gripper internal space or region 1', through an opening or passageway 21 provided at the first side wall 4.

This actuation finger 19" is operatively associated at a location externally of the shed with a suitable stop or impact member (not shown), so that upon travel of the actuation finger 19" against this stop, the clamping tongue 9 is drawn towards the rear, away from the gripper tip 1", against the force of the spiral spring 15. At the base portion 3 there is formed an upwardly protruding shoulder 22 into which there is threaded a screw or threaded bolt 23 or equivalent structure, constituting an adjustable stop for the circular sector-shaped portion 19' of the double-arm pivotal lever 19. In order to positively guide the spiral spring 15 in the opening 10 of the clamping tongue 9 there is adhesively bonded into the opening 10 a small tube or tubular element 24 which encloses the spiral spring 15 or the like.

The hook 8 is open at the first side wall 4, as generally indicated by reference character 8'. Both of the outer edges 60 and 62 of the hook arms 8" and 8''' merge into the hook tip 64, whereas the inner edges 25 and 26 of both hook arms 8''' and 8" limit the hook mouth 16. The hook end is designated by reference character 27. The inner edge 25 facing the cloth fell A is provided with a stepped portion 28, as best seen by referring to FIG. 4, and specifically such that the hook mouth 16 at the top side of the hook 8 is narrower than at its lower side.

The clamping tongue 9 protrudes by means of the free end E of its band-like portion 11 into the hook mouth 16 and is provided at the region of such end E, at its first lengthwise or longitudinal edge 70 neighboring the hook inner edge 25, likewise with a stepped portion 29. The second longitudinal or lengthwise edge 30 of the clamping tongue end E, which is more removed or distanced from the cloth fell A, serves as a guide edge. The first lengthwise or longitudinal edge 70 containing the stepped portion 29, forms together with the hook inner edge 25 and its stepped portion 28 a clamping gap 80 for a filling or weft thread F. The end E of the band-like part or portion 11 of the clamping tongue 9 is bevelled at its first lengthwise edge 70 and possesses a clamping surface 31 of lesser inclination for thicker yarns and a further clamping surface 32 of greater inclination for thinner yarns. Both of these clamping surfaces 31 and 32 can continuously merge into one another.

By means of the clamping surfaces 31 and 32 there is formed in the clamping gap 80 a wedge action, by means of which the filling thread F, independently of its thickness, is not only always positively fixedly clamped but also upon release of the clamping action is rapidly freed. The reliability of the clamping action is additionally increased by virtue of the stepped portion 28 at the hook inner edge 25 and the corresponding stepped portion 29 at the first lengthwise edge 70 at the end E of the clamping tongue 9.

The taker-gripper 1 and the clamping tongue 9 consist of a material having an appreciably lesser specific weight or density in relation to steel, and, for instance, are cast from a light metal, such as aluminum or an aluminum alloy, or fabricated of a suitable plastic material, and at the region of the clamping gap 80 are each provided with wear-resistant inserts formed of a suitable steel or a hard metal, such as a carbide metal. Each of these inserts or insert members are preferably formed of one piece and are threadably connected with the hook 8 and with the end E of the clamping tongue 9, respectively. The insert element surrounding the hook mouth 16 has been generally designated by reference character 33, and as illustrated in FIGS. 1, 3, and 4, is mounted with the aid of a screw or bolt 34 from above at the hook 8. The clamping tongue 9 is stepped at the region of its end E at its underside, and at such stepped portion there is inserted from below the insert element or piece 35 and secured by means of two screws or bolts 36 at the end E (FIGS. 1, 3, 4, and 5). The base body of the clamping tongue 9 extends up to the line 37 and the insert element or piece 35 forms the tip of the end E of the clamping tongue 9.

The basic prerequisites for a free selection of the material of the taker-gripper 1 reside in the fact that such no longer need be soldered as previously was the case with the flexible tape or band 2, since with a steel band or tape only a relatively small amount of material can be soldered. It is for this reason that the taker-gripper 1 is secured by a threaded or screw connection at the flexible tape or band 2, which will be explained more fully hereinafter based upon the showing of FIGS. 1 to 3 and 6 and 7.

As illustrated, both of the side walls 4 and 5 of the taker-gripper 1 are guided towards one another at the region of the rear gripper end and limit by means of their inner surfaces a gap 90. In this gap 90 there protrudes the front end 38 of a rail-shaped reinforcement element 39. By means of a screw 40 or equivalent structure the side walls 4 and 5 are fixed at the end 38 of the reinforcement element 39. Additionally, the taker-gripper 1 is threadably connected with the flexible band or tape 2. The band 2 is provided at its front end with an upwardly domed bead or pleat 41 in which there is inserted from below the nut members 42 by means of which there are threadably connected the screws 43 which are inserted from above through the base portion 3 of the taker-gripper 1.

The reinforcement element 39 is of rail-like configuration and is provided over its length with a number of vertical bores 44 serving for receiving attachment screws. The taker-gripper 1 and the reinforcement element 39 are fabricated of the same material and have approximately the same length. The reinforcement element 39 is placed in an upright position and is threadably connected with the flexible band or tape 2 along the central axis of such flexible band. For this purpose, the band 2 is provided at the location of the bores 44 of the reinforcement element 39 with reinforcing fins in the form of the beads or pleats 41, serving for taking-up nuts or the like in the form of the nut members 42. For assembling the taker-gripper 1 at the band 2, the taker-gripper 1 is initially threadably connected by means of the screws 40 or the like with the reinforcement element 39 and thereafter the pair of elements forming a unit, namely the taker-gripper 1 and the reinforcement element 39, are threaded to the band or tape 2.

The mode of operation of the taker-gripper 1 is as follows: This taker-gripper 1 is transported by its band 2 from the left side of the loom up to approximately the center of the shed and at that location, at the region of the hook tip 27 engages by means of the outer edge 25 of the hook 8 which confronts the cloth fell A with the filling thread F which has been offered by a not particularly illustrated bringer-gripper in a position extending perpendicular to the plane of the hook 8. The taker-gripper 1 moves into the bringer-gripper, in a manner well-known in this technology. As a result, the filling thread F which is still fixedly retained by the bringer-gripper now slides over the aforementioned outer edge 25 of the hook 8 and the hook end 27 in the direction of the clamping gap 80. During the outward movement of the taker-gripper 1, out of the weaving shed, the filling thread F arrives at the clamping gap 80 and specifically, up to the zone or region which corresponds to its thickness. At this moment, the clamping action of the bringer-gripper is released, and the filling thread F which is now fixedly clamped by the taker-gripper 1 is pulled by such taker-gripper 1 through the second half of the shed. After completion of the insertion of the filling thread F through the shed there is released the clamping action of the taker-gripper 1 at the filling thread F by virtue of the travel of the actuation finger 19″ of the pivotal lever 19 against the aforementioned stationary stop or impact member and the filling thread F is totally released.

By virtue of the fact that the clamping tongue 9 is not pivoted out as was heretofore the case in vertical direction rather is mounted so as to be displaceable or shiftable in horizontal direction within the taker-gripper 1, vertical flutter or oscillation movements of the taker-gripper 1 no longer can lead to unintentional release of the fixedly clamped filling thread F by the clamping tongue 9. Quite to the contrary, the clamping action of the clamping gap 80 is augmented by the gripper movement since the clamping tongue 9, upon withdrawal of the gripper 1 out of the shed, especially during the acceleration phase, will be pushed by virtue of its inertia into the hook mouth 16. The clamping tongue 9 however also can be drawn out of the hook mouth 16 by virtue of the very small forces for purposes of thread release. At that point in time at which the actuation finger 19″ travels against the stop, the taker-gripper 1 is braked and the clamping tongue 9, owing to its inertia, has the tendency of moving out of the hook mouth 16.

A further advantage of the inventive horizontally displaceable clamping tongue 9, in relation to a vertically pivotable clamping tongue, resides in the fact that the first type of clamping tongue, even in the presence of the smallest amount of wear, need not be readjusted, rather is self-adjusting.

Although the inventive clamping tongue which is displaceable in the lengthwise direction of the taker-gripper 1, can be used and therefore has been described by way of example and not by way of limitation in conjunction with a taker-gripper 1, it of course also can be equally well employed in conjunction with bringer-grippers.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. A gripper head for a loom for removal of a filling thread from stationary bobbins, comprising:

means defining a clamping gap for fixedly clamping a filling thread which passes through the clamping gap essentially perpendicular to a central plane of warp threads;

said means defining said clamping gap comprising a fixed stop means and a movable clamping tongue;

means for displaceably mounting said clamping tongue for movement in the lengthwise direction of the gripper head in order to open and close said clamping gap;

means defining an internal space in said gripper head;

said clamping tongue being arranged in said internal space of said gripper head and having an elongated configuration;

said gripper head having a tip portion;

said tip portion running out into a flat hook having a mouth;

said clamping gap being formed by an inner edge of said mouth and a related lengthwise edge of the clamping tongue; and said inner edge of said mouth of said hook forming said clamping gap and the related lengthwise edge of the clamping tongue each are provided with a respective step portion.

2. The gripper head as defined in claim 1, wherein:

said means for displaceably mounting said clamping tongue comprises a spring for enabling displacement of the clamping tongue for closing the clamping gap; and a controlled displacement element for oppositely displacing said clamping tongue for opening the clamping gap.

3. The gripper head as defined in claim 2, wherein:

said clamping gap is arranged in a plane which is essentially parallel to the central plane of the warp threads; and said clamping gap extending in the filling thread-insertion direction.

4. The gripper head as defined in claim 2, wherein:

said clamping gap is arranged in a plane which is essentially parallel to the central plane of the warp thread; and said clamping gap extends in the filling thread-insertion direction at an acute angle with respect to said filling thread-insertion direction.

5. A gripper head for a loom for removal of a filling thread from stationary bobbins, comprising:

means defining a clamping gap for fixedly clamping a filling thread which passes through the clamping gap essentially perpendicular to a central plane of warp threads;

said means defining said clamping gap comprising a fixed stop means and a movable clamping tongue;

means for displaceably mounting said clamping tongue for movement in the lengthwise direction of the gripper head and therefore essentially in the direction of said clamping gap in order to open and close said clamping gap;

said clamping gap being arranged in a plane which is essentially parallel to the central plane of the warp threads;

said clamping gap extending in the filling thread-insertion direction; and said clamping tongue having an elongated configuration.

6. The gripper head as defined in claim 5, wherein:

said clamping tongue contains a substantially wedge-shaped tip portion.

7. The gripper head as defined in claim 6, further including:

means defining an internal space in said gripper head;

said clamping tongue being arranged in said internal space of said gripper head;

said gripper head having a tip portion;

said tip portion running out into a substantially flat hook having a mouth;

said clamping gap being formed by an inner edge of said mouth and a related lengthwise edge of the wedge-shaped tip portion of the clamping tongue; and said inner edge of said mouth of said hook and the related lengthwise edge of the clamping tongue each being provided with a respective stepped portion.

* * * * *